US011384970B2

(12) United States Patent
Komiya et al.

(10) Patent No.: US 11,384,970 B2
(45) Date of Patent: Jul. 12, 2022

(54) HEAT EXCHANGER AND REFRIGERATION CYCLE APPARATUS

(71) Applicant: Mitsubishi Electric Corporation, Tokyo (JP)

(72) Inventors: Yuta Komiya, Tokyo (JP); Shin Nakamura, Tokyo (JP); Shinya Higashiiue, Tokyo (JP); Akira Ishibashi, Tokyo (JP); Tsuyoshi Maeda, Tokyo (JP); Ryota Akaiwa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 85 days.

(21) Appl. No.: 16/772,881

(22) PCT Filed: Dec. 25, 2017

(86) PCT No.: PCT/JP2017/046448
§ 371 (c)(1),
(2) Date: Jun. 15, 2020

(87) PCT Pub. No.: WO2019/130394
PCT Pub. Date: Jul. 4, 2019

(65) Prior Publication Data
US 2021/0164709 A1 Jun. 3, 2021

(51) Int. Cl.
*F25D 17/06* (2006.01)
*F25B 39/00* (2006.01)
*F25B 39/02* (2006.01)

(52) U.S. Cl.
CPC ..... *F25B 39/00* (2013.01); *F25B 39/02* (2013.01); *F25B 39/028* (2013.01)

(58) Field of Classification Search
CPC ..... F25B 39/00; F25B 39/028; F25B 39/02; F25B 39/04; F25B 41/00; F25B 13/00;
(Continued)

(56) References Cited

U.S. PATENT DOCUMENTS 7,931,073 B2 4/2011 Gorbounov et al.
2016/0109168 A1 4/2016 Baba
(Continued)

FOREIGN PATENT DOCUMENTS

JP 2014-228234 A 12/2014
JP 2015-055415 A 3/2015
(Continued)

OTHER PUBLICATIONS

The attached pdf file is translation of foreign reference JP 2015055415 A (Year: 2015).*
(Continued)

*Primary Examiner* — Henry T Crenshaw
*Assistant Examiner* — Kamran Tavakoldavani
(74) *Attorney, Agent, or Firm* — Posz Law Group, PLC

(57) ABSTRACT

An auxiliary heat exchange unit of a heat exchanger has a first auxiliary heat exchange region and a second auxiliary heat exchange region. A main heat exchange unit has a first main heat exchange region, a second main heat exchange region, a third main heat exchange region, and a fourth main heat exchange region. The auxiliary heat exchange unit and the main heat exchange unit are configured to cause refrigerant to flow successively through the first auxiliary heat exchange region, the second auxiliary heat exchange region, the first main heat exchange region, the second main heat exchange region, the fourth main heat exchange region, and the third main heat exchange region when the heat exchanger functions as an evaporator.

7 Claims, 12 Drawing Sheets

(58) Field of Classification Search
CPC .... F28D 1/0452; F28D 1/053; F28D 1/05391; F28D 2021/0071; F28D 2021/0084
USPC ..... 62/426
See application file for complete search history.

(56) References Cited

U.S. PATENT DOCUMENTS

| | | | | |
|---|---|---|---|---|
| 2016/0223265 | A1 | 8/2016 | Jindou et al. | |
| 2017/0153049 | A1 | 6/2017 | Kondo et al. | |
| 2017/0211857 | A1* | 7/2017 | Takeichi | F25B 39/02 |
| 2018/0100659 | A1 | 4/2018 | Yoshimura et al. | |
| 2018/0135900 | A1* | 5/2018 | Jindou | F25B 39/00 |

FOREIGN PATENT DOCUMENTS

| | | | | |
|---|---|---|---|---|
| JP | 2015055415 | A | * | 3/2015 |
| JP | 2015-078830 | A | | 4/2015 |
| WO | 2016/158193 | A1 | | 10/2016 |

OTHER PUBLICATIONS

Pdf is translation of foreign reference JP 2015055415 A (Year: 2015).*
Indian Office Action dated Mar. 2, 2021, issued in corresponding Indian Patent Application No. 202027025571 (and English Machine Translation).
International Search Report of the International Searching Authority dated Mar. 13, 2018 for the corresponding international application No. PCT/JP2017/046448 (and English translation).

* cited by examiner

HEAT EXCHANGER AND REFRIGERATION CYCLE APPARATUS

CROSS REFERENCE TO RELATED APPLICATION

This application is a U.S. national stage application of International Application PCT/JP2017/046448 filed on Dec. 25, 2017, the contents of which are incorporated herein by reference.

TECHNICAL FIELD

The present invention relates to a heat exchanger and a refrigeration cycle apparatus.

BACKGROUND

It has been conventionally known that the heat exchange performance of a heat exchanger that includes fins and heat transfer tubes and performs heat exchange between refrigerant flowing through the heat transfer tubes and air flowing outside the heat transfer tubes changes depending on a refrigerant flow path. In particular, for a heat exchanger including a plurality of banks, heat exchange performance changes depending on the relationship of circulation between refrigerant and air.

For example, Japanese Patent Laying-Open No. 2015-78830 (PTL 1) discloses a heat exchanger in which an auxiliary windward bank portion, an auxiliary leeward bank portion, a header collecting tube, a principal leeward bank portion, and a principal windward bank portion are disposed in series in a refrigerant flow path. When this heat exchanger functions as an evaporator, refrigerant flows successively through the auxiliary windward bank portion, the auxiliary leeward bank portion, the principal leeward bank portion, and the principal windward bank portion. This configuration can secure a temperature difference between refrigerant and air in a refrigerant flow path (a heat exchanger portion disposed above the header) in which refrigerant in the gas single-phase state easily flows, thereby improving the performance of the evaporator.

PATENT LITERATURE

PTL 1: Japanese Patent Laying-Open No. 2015-78830

It is desirable that, when the heat exchanger including a plurality of banks arranged in an air flow direction functions as an evaporator, the temperature of the heat exchange unit in the leeward bank portion be lower than the temperature of the heat exchange unit of the windward bank portion. The cause of this will be described with reference to FIGS. 11 and 12. FIGS. 11 and 12 are temperature distribution charts showing changes in the temperatures of air and a heat exchange unit when a heat exchanger including a plurality of banks functions as an evaporator. When a heat exchanger temperature Tb of the leeward bank portion is lower than a heat exchanger temperature Tf of the windward bank portion as shown in FIG. 11, the heat exchanger temperature is lower than the air temperature in the leeward bank portion, and thus, the heat exchanger can satisfactorily deliver the performance of the evaporator. When heat exchanger temperature Tb of the leeward bank portion is higher than heat exchanger temperature Tf of the windward bank portion as shown in FIG. 12, however, the heat exchanger temperature may be higher than the air temperature in the leeward bank portion. In this case, the heat exchanger may fail to satisfactorily deliver the performance of the evaporator due to a rise in the air temperature in the leeward bank portion.

When the heat exchanger functions as an evaporator in the refrigeration cycle apparatus, refrigerant in the gas-liquid two-phase state may flow into the heat exchanger, the refrigerant may transition from the gas-liquid two-phase state to a gas single-phase state, and accordingly, the refrigerant in the gas single-phase state may flow out. In other words, when the heat exchanger functions as an evaporator, the flow of refrigerant is divided to a region in the gas-liquid two-phase state (hereinbelow, referred to as a gas-liquid two-phase region) and a region in the gas single-phase state (hereinbelow, referred to as a gas single-phase region).

A refrigerant pressures decreases in the refrigerant flow direction due to a friction loss of the refrigerant. A saturation temperature of the refrigerant also decreases along with the decrease in refrigerant pressure, and accordingly, the refrigerant temperature decreases in the refrigerant flow direction in the gas-liquid two-phase region. Also, the refrigerant in the gas single-phase state absorbs heat from the air, entering the overheated state. In the gas single-phase region, the refrigerant temperature thus rises in the refrigerant flow direction.

When the heat exchanger including a plurality of banks functions as an evaporator, as the refrigerant flows in from the windward bank portion and flows out of the leeward bank portion in the gas-liquid two-phase region, the leeward bank portion has a temperature lower than that of the windward bank portion and thus can satisfactorily deliver the performance of the evaporator. That is to say, when the heat exchanger including the plurality of banks functions as an evaporator, it is desirable that the refrigerant and air be parallel flows in the gas-liquid two-phase region.

When the heat exchanger including a plurality of banks functions as an evaporator, as the refrigerant flows in from the leeward bank portion and flows out of the windward bank portion in the gas single-phase region, the leeward bank portion has a temperature lower than that of the windward bank portion and thus can satisfactorily deliver the performance of the evaporator. That is to say, when the heat exchanger including the plurality of banks functions as an evaporator, it is desirable that the refrigerant and air be counterflows in the gas single-phase region.

However, when the heat exchanger described in the above publication functions as an evaporator, refrigerant and air flow opposite to each other in the main heat exchange unit disposed downstream in a refrigerant flow. That is to say, in the main heat exchange unit, refrigerant and air are counterflows in both of a refrigerant flow path (a heat exchanger portion disposed above the header) which easily becomes the gas single-phase region and a refrigerant flow path (a heat exchanger portion disposed below the header) that easily becomes the gas-liquid two-phase region.

As described above, when the heat exchanger functions as an evaporator, and when refrigerant and air flow in the opposite directions in the refrigerant flow path that easily becomes the gas-liquid two-phase region, a temperature difference between refrigerant and air is not secured in the leeward bank portion. Consequently, the heat exchanger may not satisfactorily deliver the performance of an evaporator.

SUMMARY

The present invention has been made in view of the above problem and has an object to provide a heat exchanger capable of securing the performance of an evaporator.

A heat exchanger according the present invention has a plurality of heat transfer tubes and is provided for heat exchange between refrigerant flowing inside the plurality of heat transfer tubes and air flowing outside the plurality of heat transfers. The heat exchanger includes an auxiliary heat exchange unit and a main heat exchange unit. The auxiliary heat exchange unit has a first auxiliary heat exchange region and a second auxiliary heat exchange region. The second auxiliary heat exchange region faces the first auxiliary heat exchange region in a flow direction in which the air flows. The main heat exchange unit has a first main heat exchange region, a second main heat exchange region, a third main heat exchange region, and a fourth main heat exchange region. The second main heat exchange region faces the first main heat exchange region in the flow direction. The third main heat exchange region is disposed opposite to the first auxiliary heat exchange region across the first main heat exchange region. The fourth main heat exchange region faces the third main heat exchange region in the flow direction and is disposed opposite to the second auxiliary heat exchange region across the second main heat exchange region. The plurality of heat transfer tubes of each of the first auxiliary heat exchange region and the second auxiliary heat exchange region are fewer than the plurality of heat transfer tubes of each of the first main heat exchange region, the second main heat exchange region, the third main heat exchange region, and the fourth main heat exchange region. The first auxiliary heat exchange region, the first main heat exchange region, and the third main heat exchange region are disposed windward of the second auxiliary heat exchange region, the second main heat exchange region, and the fourth main heat exchange region, respectively, in the flow direction. The auxiliary heat exchange unit and the main heat exchange unit are configured to cause the refrigerant to flow successively through the first auxiliary heat exchange region, the second auxiliary heat exchange region, the first main heat exchange region, the second main heat exchange region, the fourth main heat exchange region, and the third main heat exchange region when the heat exchanger functions as an evaporator.

In the heat exchanger according to the present invention, the auxiliary heat exchange unit and the main heat exchange unit are configured to cause refrigerant to flow successively through the first auxiliary heat exchange region, the second auxiliary heat exchange region, the first main heat exchange region, the second main heat exchange region, the fourth main heat exchange region, and the third main heat exchange region when the heat exchanger functions as an evaporator. This allows refrigerant in the gas-liquid two-phase state and air to flow parallel to each other in the first main heat exchange region and the second main heat exchange region, allowing refrigerant in the gas single-phase state and air to flow opposite to each other in the fourth main heat exchange region and the third main heat exchange region. Consequently, a temperature difference between refrigerant and air can be secured in the first main heat exchange region and the second main heat exchange region and also in the fourth main heat exchange region and the third main heat exchange region, thus securing the performance of the evaporator of the heat exchanger.

DETAILED DESCRIPTION

Embodiments of the present invention will now be described in detail with reference to the drawings. Each of the embodiments will describe an air conditioning apparatus as an example refrigeration cycle apparatus and also describes a case in which a heat exchanger recited in CLAIMS is used as an outdoor heat exchanger. The heat exchanger recited in CLAIMS may be used as an indoor heat exchanger.

Embodiment 1

Figure 1:
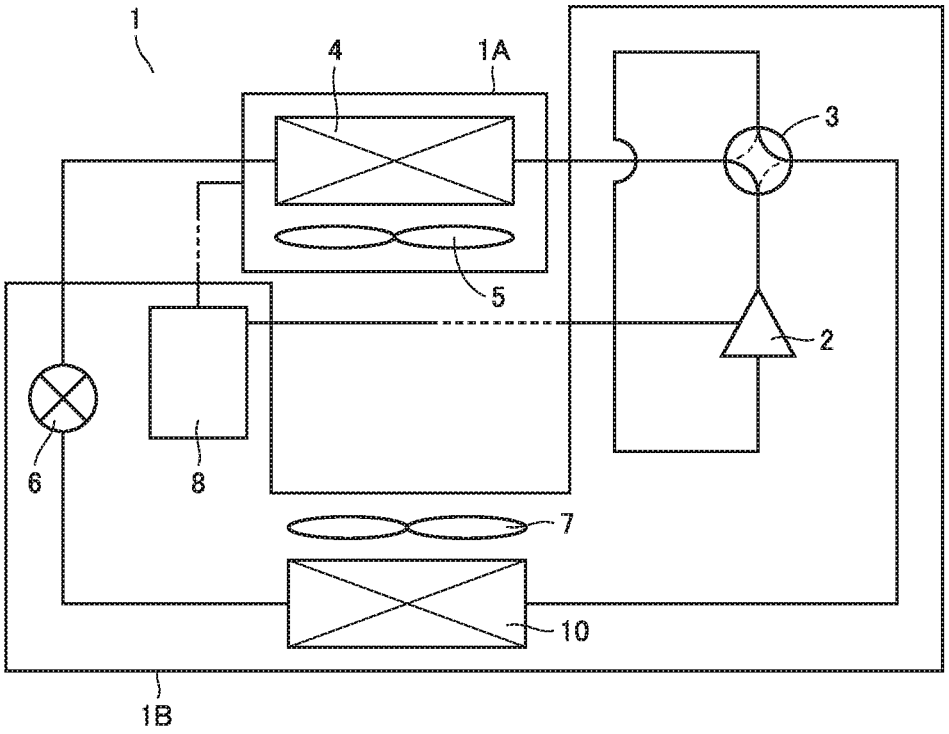
FIG. 1 shows an example refrigerant circuit of an air conditioning apparatus according to Embodiment 1.

First, an overall configuration (refrigerant circuit) of an air conditioning apparatus 1, serving as a refrigeration cycle apparatus according to Embodiment 1 of the present invention, will be described with reference to FIG. 1. As shown in FIG. 1, air conditioning apparatus 1 includes a compressor 2, a four-way valve 3, an indoor heat exchanger 4, an indoor blower 5, a throttle device 6, an outdoor blower 7, a controller 8, and an outdoor heat exchanger 10. Compressor 2, four-way valve 3, indoor heat exchanger 4, throttle device 6, and outdoor heat exchanger 10 are connected by a refrigerant pipe. Compressor 2 serves to compress refrigerant flowing into indoor heat exchanger 4 or outdoor heat exchanger 10. Indoor blower 5 serves to flow air to indoor heat exchanger 4, and outdoor blower 7 serves to flow air to outdoor heat exchanger 10.

Indoor heat exchanger 4 and indoor blower 5 are disposed in an indoor unit 1A. Outdoor heat exchanger 10 and outdoor blower 7 are disposed in an outdoor unit 1B. Compressor 2, four-way valve 3, throttle device 6, and controller 8 are also disposed in outdoor unit 1B. A series of operations of air conditioning apparatus 1 are controlled by controller 8.

Figure 2:
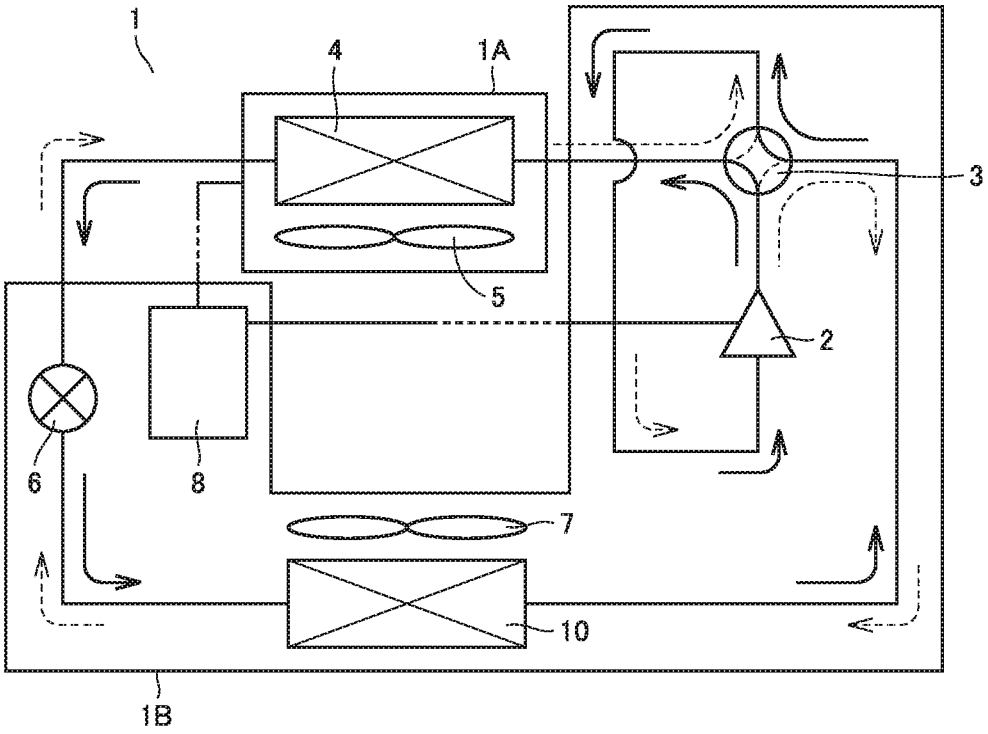
FIG. 2 shows a flow of refrigerant in the refrigerant circuit for illustrating an operation of the air conditioning apparatus according to Embodiment 1.

Next, operations of air conditioning apparatus 1 of the present embodiment will be described with reference to FIG. 2. Solid arrows in the figure indicate a flow of refrigerant during heating operation, and dashed arrows in the figure indicate a flow of refrigerant during cooling operation.

Air conditioning apparatus 1 of the present embodiment can selectively perform the cooling operation and the heating operation. In the cooling operation, refrigerant circulates successively through compressor 2, four-way valve 3, outdoor heat exchanger 10, throttle device 6, and indoor heat exchanger 4 in refrigerant circuit. Outdoor heat exchanger 10 functions as a condenser. Heat exchange is performed between the refrigerant flowing through outdoor heat exchanger 10 and the air blown by outdoor blower 7. Indoor heat exchanger 4 functions as an evaporator. Heat exchange is performed between the refrigerant flowing through indoor heat exchanger 4 and the air blown by indoor blower 5. In the heating operation, refrigerant circulates successively through compressor 2, four-way valve 3, indoor heat exchanger 4, throttle device 6, and outdoor heat exchanger 10 in the refrigerant circuit. Indoor heat exchanger 4 functions as a condenser. Outdoor heat exchanger 10 functions as an evaporator.

Next, with reference to FIGS. 3 and 4, a configuration of outdoor heat exchanger 10 will be described as an example heat exchanger that functions as an evaporator. Outdoor heat exchanger 10 will be described merely as heat exchanger 10 as appropriate.

Heat exchanger 10 according to the present embodiment has a plurality of heat transfer tubes 20. Heat exchanger 10 serves to perform heat exchange between the refrigerant flowing inside heat transfer tubes 20 and the air flowing outside heat transfer tubes 20. Heat exchanger 10 has a plurality of heat exchange bank portions 11. Heat exchanger 10 of the present embodiment has two banks of heat exchange bank portions 11 formed of a windward bank portion and a leeward bank portion. Heat exchange bank portions 11 are disposed side by side in an air flow direction (a direction x in the figure). Each of heat exchange bank portions 11 has heat transfer tubes 20. In heat exchanger 10 according to the present embodiment, a refrigerant flow path through which refrigerant flows is formed in each of heat transfer tubes 20. Heat exchanger 10 is formed to perform heat exchange between refrigerant flowing through the refrigerant flow path of each of heat transfer tubes 20 and air flowing through outside each of heat transfer tubes 20.

Heat exchanger 10 mainly includes a main heat exchange unit (main unit) 30 and an auxiliary heat exchange unit (auxiliary unit) 40. Auxiliary heat exchange unit 40 is formed of heat transfer tubes 20 fewer than those of main heat exchange unit 30. In the present embodiment, heat exchanger 10 is divided into main heat exchange unit 30 and auxiliary heat exchange unit 40 in the direction in which heat transfer tubes 20 are disposed (a direction y in the figure). In the present embodiment, auxiliary heat exchange unit 40 is disposed below main heat exchange unit 30.

In main heat exchange unit 30 and auxiliary heat exchange unit 40, heat transfer tubes 20 are disposed to pass through a plurality of plate-shaped fins 21. Each of heat transfer tubes 20 is, for example, a flat tube that has a major axis and a minor axis and has a flat sectional shape. Each of heat transfer tubes 20 is not limited to the flat tube and may be, for example, a circular tube having a circular sectional shape or an elliptic tube having an elliptic sectional shape.

Main heat exchange unit 30 and auxiliary heat exchange unit 40 are disposed such that refrigerant continuously flows through main heat exchange unit 30 and auxiliary heat exchange unit 40 via a dispenser 50. Dispenser 50 is a header collecting tube through which refrigerant circulates and which has a space in which refrigerant is dispensed. Dispenser 50 is not limited thereto and may be a distributor.

Main heat exchange unit 30 is divided into at least two or more main-unit sections 31 in direction y in the figure. Main-unit sections 31 are disposed such that refrigerant continuously flows through main-unit sections 31 via a main-unit refrigerant pipe component 60. Main-unit refrigerant pipe component 60 is a refrigerant pipe component obtained by connecting a header collecting tube that collects refrigerant and a header dispensing tube that dispenses refrigerant by a pipe. Main-unit refrigerant pipe component 60 is not limited thereto and may be a refrigerant pipe connecting refrigerant flow paths of heat transfer tubes 20 to each other in series.

Figure 3:
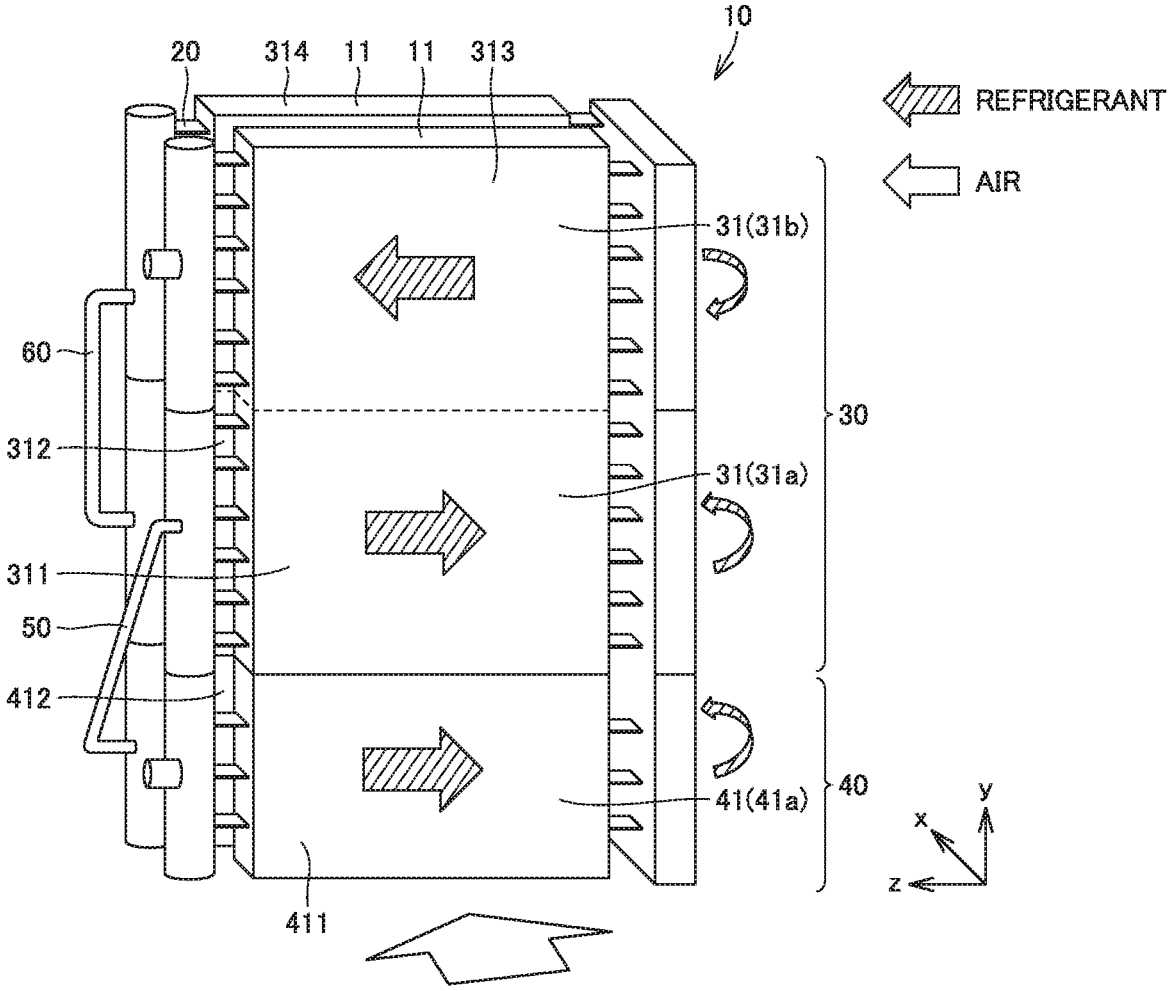
FIG. 3 is a perspective view showing an outline of a heat exchanger according to Embodiment 1.
Figure 4:
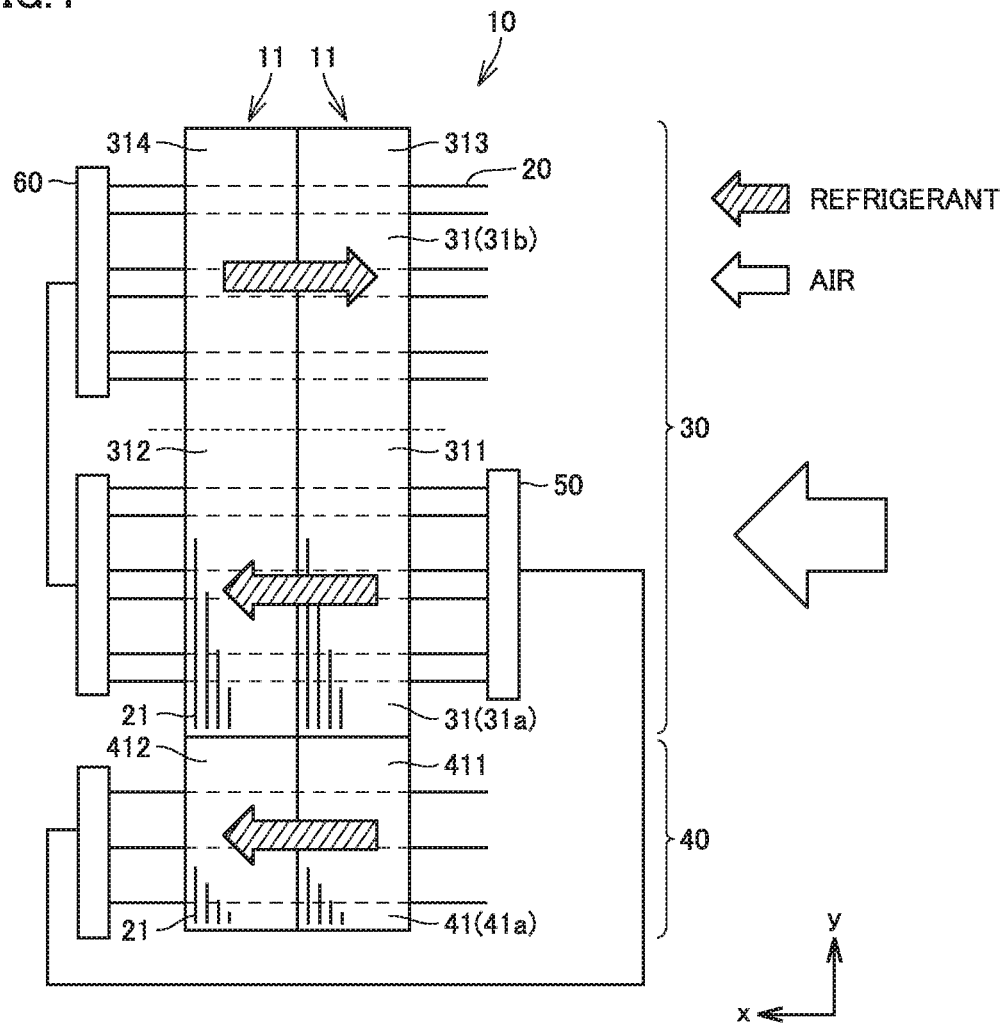
FIG. 4 is a schematic view showing an outline of the heat exchanger according to Embodiment 1.

FIG. 3 shows an outline of heat exchanger 10 when main heat exchange unit 30 is divided into two main-unit sections 31 in heat exchanger 10. As shown in FIG. 3, main heat exchange unit 30 has a main-unit section 31*a* and a main-unit section 31*b* as main-unit sections 31.

Main heat exchange unit 30 has a plurality of main heat exchange regions. Main heat exchange unit 30 has a first main heat exchange region 311, a second main heat exchange region 312, a third main heat exchange region 313, and a fourth main heat exchange region 314. First main heat exchange region 311 and second main heat exchange region 312 constitute main-unit section 31*a*. Third main heat exchange region 313 and fourth main heat exchange region 314 constitute main-unit section 31*b*.

Auxiliary heat exchange unit 40 has an auxiliary-unit section 41*a* as an auxiliary-unit section 41. Auxiliary heat exchange unit 40 has a plurality of auxiliary heat exchange regions. Auxiliary heat exchange unit 40 has a first auxiliary heat exchange region 411 and a second auxiliary heat exchange region 412. First auxiliary heat exchange region 411 and second auxiliary heat exchange region 412 constitute auxiliary-unit section 41*a*. Second auxiliary heat exchange region 412 faces first auxiliary heat exchange region 411 in a flow direction in which air flows, indicated by a white arrow in the figure.

Heat transfer tubes 20 of each of first auxiliary heat exchange region 411 and second auxiliary heat exchange region 412 are fewer than heat transfer tubes 20 of each of first main heat exchange region 311, second main heat exchange region 312, third main heat exchange region 313, and fourth main heat exchange region 314.

Second main heat exchange region 312 faces first main heat exchange region 311 in the flow direction in which air flows. Third main heat exchange region 313 is disposed opposite to first auxiliary heat exchange region 411 across first main heat exchange region 311. Fourth main heat exchange region 314 faces third main heat exchange region 313 in the flow direction in which air flows. Fourth main heat exchange region 314 is disposed opposite to second auxiliary heat exchange region 412 across second main heat exchange region 312.

First auxiliary heat exchange region 411, first main heat exchange region 311, and third main heat exchange region 313 are disposed windward of second auxiliary heat exchange region 412, second main heat exchange region 312, and fourth main heat exchange region 314, respectively, in the flow direction.

When heat exchanger 10 functions as an evaporator, auxiliary heat exchange unit 40 and main heat exchange unit 30 are configured to cause refrigerant to flow successively through first auxiliary heat exchange region 411, second auxiliary heat exchange region 412, first main heat exchange region 311, second main heat exchange region 312, fourth main heat exchange region 314, and third main heat exchange region 313.

When heat exchanger 10 functions as an evaporator, refrigerant flows successively through auxiliary heat exchange unit 40, dispenser 50, and main heat exchange unit 30. That is to say, when heat exchanger 10 functions as an evaporator, auxiliary heat exchange unit 40 is disposed upstream and main heat exchange unit 30 is disposed midstream to downstream in a flow of refrigerant.

Figure 5:
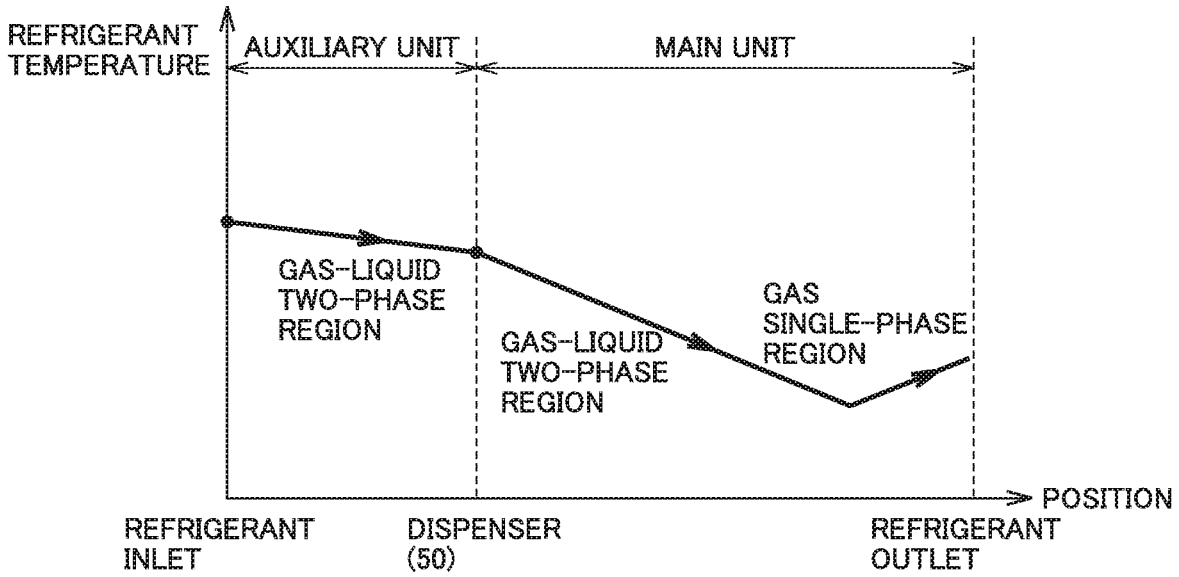
FIG. 5 is a temperature distribution chart schematically showing changes in refrigerant temperature when the heat exchanger according to Embodiment 1 functions as an evaporator.

FIG. 5 is a temperature distribution chart showing an outline of changes in refrigerant temperature when heat exchanger 10 according to Embodiment 1 of the present invention functions as an evaporator. As shown in FIG. 5, when heat exchanger 10 functions as an evaporator, refrigerant in the gas-liquid two-phase state which has a high wetness may flow into auxiliary heat exchange unit (auxiliary unit) 40, and refrigerant in the gas single-phase state which has a wetness of zero or less may flow out of main heat exchange unit (main unit) 30. When heat exchanger 10 functions as an evaporator, thus, the gas-liquid two-phase region and the gas single-phase region are formed in heat exchanger 10.

In a common refrigeration cycle apparatus, the refrigerant that has flowed out of the evaporator is sucked by a compressor. As liquid refrigerant is compressed, the compressor may break down, and accordingly, refrigerant that flows out of the evaporator is desirably in the gas single-phase state. Also, refrigerant in the gas single-phase state has a lower heat transfer coefficient than that of refrigerant in the gas-liquid two-phase state, and accordingly, the gas single-phase region is made small in the evaporator. It is thus desirable that, when heat exchanger 10 functions as an evaporator, only the most downstream portion in a flow of refrigerant be the gas single-phase region, and the other portion be the gas-liquid two-phase region.

In the present embodiment, thus, when heat exchanger 10 functions as an evaporator, auxiliary heat exchange unit 40 is configured to be the gas-liquid two-phase region, main heat exchange unit 30 is configured to be the gas-liquid two-phase region in an upstream portion to a midstream portion in the flow of refrigerant and be the gas single-phase region in a downstream portion in main heat exchange unit 30.

Next, the function and effect of the present embodiment will be described.

When heat exchanger 10 functions as an evaporator, refrigerant flows successively through main-unit section 31*a* and main-unit section 31*b* in main heat exchange unit 30. That is to say, in main heat exchange unit 30 of heat exchanger 10, main-unit section 31*a* is disposed most upstream in the flow of refrigerant in the evaporator. Main-unit section 31*a* will be referred to as main-unit upstream section 31*a* as appropriate. In main heat exchange unit 30 of heat exchanger 10, main-unit section 31*b* is disposed most downstream in the flow of refrigerant in the evaporator. Main-unit section 31*b* will be referred to as main-unit downstream section 31*b* as appropriate.

As described above, when heat exchanger 10 functions as an evaporator, the upstream portion to the midstream portion in the flow of refrigerant is the gas-liquid two-phase region in main heat exchange unit 30. That is to say, refrigerant is located in the gas-liquid two-phase region in main-unit upstream section 31*a*. In main-unit upstream section 31*a*, refrigerant flows into the windward bank portion and flows out of the leeward bank portion. Specifically, refrigerant flows from first main heat exchange region 311 toward second main heat exchange region 312. That is to say, when heat exchanger 10 functions as an evaporator, refrigerant and air flow parallel to each other in main-unit upstream section 31*a* that is the gas-liquid two-phase region. With the above configuration, the temperature of the heat exchanger is lower in the leeward bank portion than in the windward bank portion in main-unit upstream section 31*a*, thus securing a temperature difference between air and refrigerant in the leeward bank portion. The performance of the evaporator of heat exchanger 10 can thus be improved.

As described above, when heat exchanger 10 functions as an evaporator, the downstream portion in the flow of refrigerant is the gas single-phase region in main heat exchange unit 30. That is to say, refrigerant is located in the gas single-phase region in main-unit downstream section 31*b*. In main-unit downstream section 31*b*, refrigerant flows into the leeward bank portion and flows out of the windward bank portion. Specifically, refrigerant flows from fourth main heat exchange region 314 toward third main heat exchange region 313. That is to say, when heat exchanger 10 functions as an evaporator, refrigerant and air flow opposite to each other in main-unit downstream section 31*b* that is the gas single-phase region. With the above configuration, the temperature of the heat exchanger is lower in the leeward bank portion than in the windward bank portion in main-unit downstream section 31*b*, thus securing a temperature difference between air and refrigerant in the leeward bank portion. The performance of the evaporator of heat exchanger 10 can thus be improved.

When heat exchanger 10 functions as an evaporator, auxiliary heat exchange unit 40 is the gas-liquid two-phase region. That is to say, refrigerant is located in the gas-liquid two-phase region in auxiliary-unit section 41*a*. In auxiliary-unit section 41*a*, refrigerant flows into the windward bank portion and flows out of the leeward bank portion. Specifically, refrigerant flows from first auxiliary heat exchange region 411 toward second auxiliary heat exchange region 412. That is to say, when heat exchanger 10 functions as an evaporator, refrigerant and air flow parallel to each other in auxiliary-unit section 41*a* that is the gas-liquid two-phase region. With the above configuration, the temperature of the heat exchanger bank portion is lower in the leeward bank portion than in the windward bank portion in auxiliary-unit section 41*a*, thus securing a temperature difference between air and refrigerant in the leeward bank portion. The performance of the evaporator of heat exchanger 10 can thus be improved.

As described above, in heat exchanger 10 according to the present embodiment, auxiliary heat exchange unit 40 and main heat exchange unit 30 are configured to cause refrigerant to flow successively through the first auxiliary heat exchange region, the second auxiliary heat exchange region, the first main heat exchange region, the second main heat exchange region, the fourth main heat exchange region, and the third main heat exchange region when heat exchanger 10 functions as an evaporator. Consequently, refrigerant in the gas-liquid two-phase state and air can flow parallel to each other in first main heat exchange region 311 and second main heat exchange region 312, so that refrigerant in the gas single-phase state and air can flow opposite to each other in fourth main heat exchange region 314 and third main heat exchange region 313. A temperature difference between refrigerant and air can thus be secured in first main heat exchange region 311 and second main heat exchange region 312 and in fourth main heat exchange region 314 and third main heat exchange region 313. The performance of the evaporator of heat exchanger 10 can thus be improved.

As described above, when refrigerant and air flow opposite to each other through the refrigerant flow path that easily becomes the gas-liquid two-phase region, a temperature difference between refrigerant and air may not be secured in the leeward bank portion, and accordingly, the performance of the evaporator may not be fully delivered. In particular, when heat transfer tube 20 has a small tube inside diameter, a pressure loss decreases excessively, for example, at high viscosity of the refrigerant. When refrigerant and air flow opposite to each other through the refrigerant flow path that easily becomes the gas-liquid two-phase region, thus, a temperature difference between refrigerant and air may not be secured in the leeward bank portion, and the performance of the evaporator is highly unlikely to be delivered. In heat exchanger 10 according to the present embodiment, the performance of the evaporator can be secured even when the pressure of the refrigerant dramatically drops.

Air conditioning apparatus 1 according to the present embodiment includes heat exchanger 10 described above, and thus, air conditioning apparatus 1 that can secure the performance of the evaporator of heat exchanger 10 can be provided.

Next, heat exchangers 10 according to Modifications 1 to 3 of the present embodiment will be described with reference to FIGS. 6 to 8. Heat exchangers 10 according to Modifications 1 to 3 of the present embodiment described below have the same components and effects as those of heat exchanger 10 according to the present embodiment described above, unless otherwise noted. The same components as those of heat exchanger 10 according to the present embodiment will thus be denoted by the same references, description of which will not be repeated.

Heat exchanger 10 according to Modification 1 of the present embodiment will be described with reference to FIG. 6. FIG. 6 is a schematic view showing an outline of heat exchanger 10 when main heat exchange unit 30 is divided into three or more main-unit sections 31 in heat exchanger 10. As shown in FIG. 6, main heat exchange unit 30 is divided into a main-unit section 31*a*, a main-unit section 31*b*, and a main-unit section 31*c*.

Main heat exchange unit 30 further has a fifth main heat exchange region 315 and a sixth main heat exchange region 316. Fifth main heat exchange region 315 and sixth main heat exchange region 316 constitute main-unit section 31*c*. Fifth main heat exchange region 315 is disposed between first main heat exchange region 311 and third main heat exchange region 313. Sixth main heat exchange region 316 is disposed between second main heat exchange region 312 and fourth main heat exchange region 314.

Main heat exchange unit 30 is configured to cause refrigerant to flow successively through first main heat exchange region 311, second main heat exchange region 312, fifth main heat exchange region 315, sixth main heat exchange region 316, fourth main heat exchange region 314, and third main heat exchange region 313 when heat exchanger 10 functions as an evaporator.

When heat exchanger 10 functions as an evaporator, refrigerant flows successively through main-unit section 31*a*, main-unit section 31*c*, and main-unit section 31*b* in main heat exchange unit 30. That is to say, main-unit section 31*a* is disposed most upstream in the flow of refrigerant of the evaporator in main heat exchange unit 30 of heat exchanger 10. Main-unit section 31*a* will be referred to as main-unit upstream section 31*a* as appropriate. Main-unit section 31*b* is disposed most downstream in the flow of refrigerant of the evaporator in main heat exchange unit 30 of heat exchanger 10. Main-unit section 31*b* will be referred to as main-unit downstream section 31*b* as appropriate. Main-unit section 31*c* is disposed midstream between main-unit upstream section 31*a* and main-unit downstream section 31*b* in main heat exchange unit 30 of heat exchanger 10. Main-unit section 31*c* will be referred to as main-unit midstream section 31*c* as appropriate.

Figure 6:
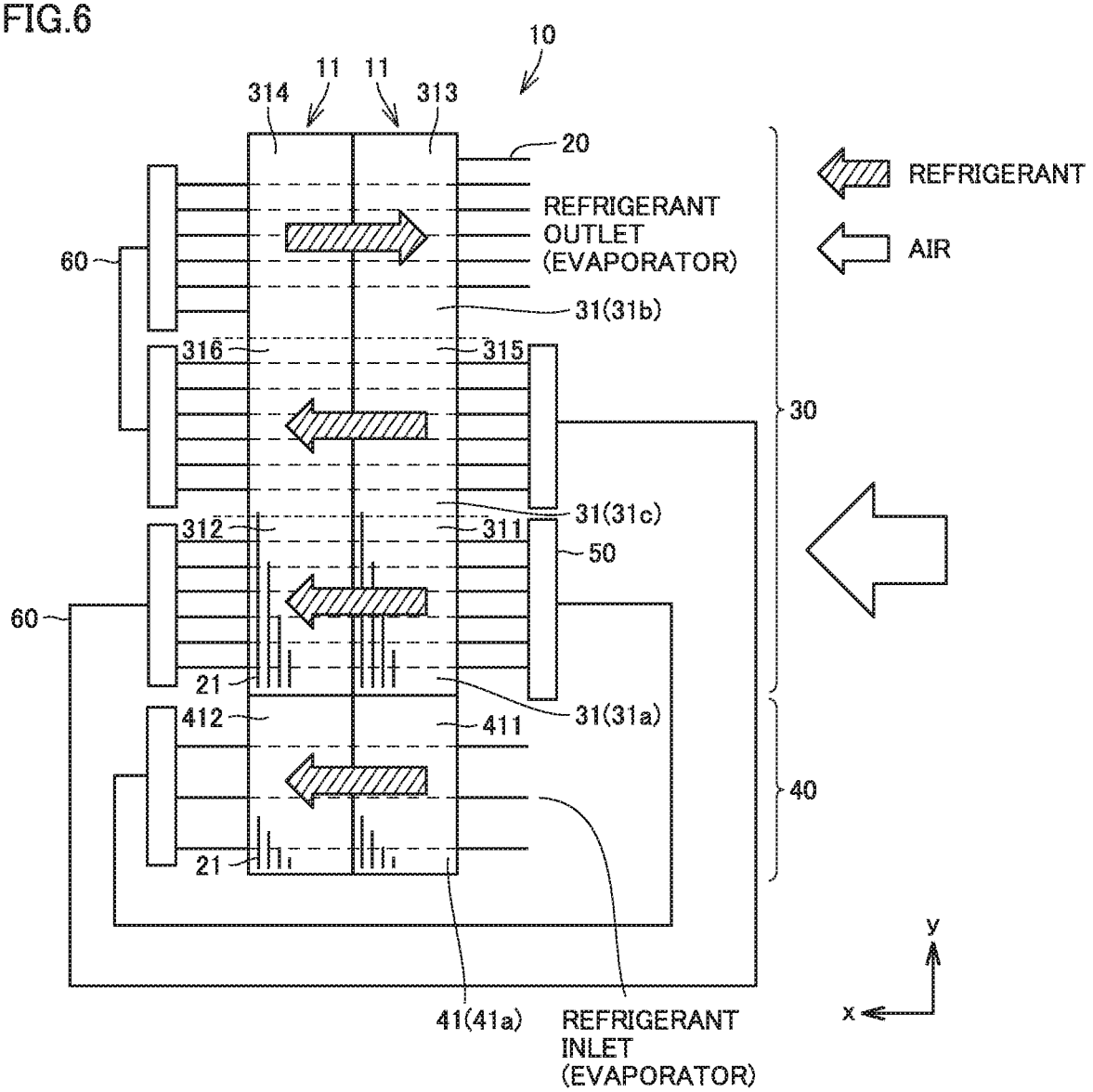
FIG. 6 is a schematic view showing an outline of a heat exchanger according to Modification 1 of Embodiment 1.

Although main-unit midstream section 31*c* is formed of one main-unit section 31 with reference to FIG. 6, the present invention is not limited thereto, and main-unit section 31*c* may be formed of two or more main-unit sections 31.

As described above, when heat exchanger 10 functions as an evaporator, the upstream portion to the midstream portion in the flow of refrigerant is the gas-liquid two-phase region in main heat exchange unit 30. That is to say, in main-unit upstream section 31*a* and main-unit midstream section 31*c*, refrigerant is located in the gas-liquid two-phase region. In main-unit upstream section 31*a* and main-unit midstream section 31*c*, refrigerant flows into the windward bank portion and flows out of the leeward bank portion. Specifically, refrigerant flows from first main heat exchange region 311 toward second main heat exchange region 312. Also, refrigerant flows from fifth main heat exchange region 315 toward sixth main heat exchange region 316. That is to say, when heat exchanger 10 functions as an evaporator, refrigerant and air flow parallel to each other in main-unit upstream section 31*a* and main-unit midstream section 31*c* that are gas-liquid two-phase region. With the above configuration, the temperature of the heat exchanger is lower in the leeward bank portion than in the windward bank portion in main-unit upstream section 31*a* and main-unit midstream section 31*c*, and accordingly, a temperature difference between air and refrigerant can be secured in the leeward bank portion. The performance of the evaporator of heat exchanger 10 can thus be improved.

As described above, when heat exchanger 10 function as an evaporator, refrigerant and air flow opposite to each other in main-unit downstream section 31*b* that is the gas single-phase region. With the above configuration, the temperature of the heat exchanger is lower in the windward bank than in the leeward bank portion in main-unit downstream section 31*b*, and accordingly, a temperature difference between air and refrigerant can be secured in the leeward bank portion. The performance of the evaporator of heat exchanger 10 can thus be improved.

In heat exchanger 10 according to Modification 1 of the present embodiment, main heat exchange unit 30 includes fifth main heat exchange region 315 and sixth main heat exchange region 316, and thus causes refrigerant in the gas-liquid two-phase state and air to flow parallel to each other also in fifth main heat exchange region 315 and sixth main heat exchange region 316. Since main heat exchange unit 30 includes fifth main heat exchange region 315 and sixth main heat exchange region 316, fifth main heat exchange region 315 and sixth main heat exchange region 316 are caused to become the gas-liquid two-phase region (midstream portion), facilitating division into the gas-liquid two-phase region (midstream portion) and the gas single-phase region (downstream portion). Main heat exchange unit 30 can be disposed in order of the upstream portion, midstream portion, and downstream portion in the flow of refrigerant to reduce a heat loss (heat conduction loss)

between refrigerants which is generated as the heat of refrigerant flowing through each of adjacent heat transfer tubes 20 moves along fins 21.

Next, heat exchanger 10 according to Modification 2 of the present embodiment will be described with reference to FIG. 7. FIG. 7 is a schematic view showing an outline of heat exchanger 10 when auxiliary heat exchange unit 40 is divided into two auxiliary-unit sections 41 in heat exchanger 10. As shown in FIG. 7, auxiliary heat exchange unit 40 is divided into auxiliary-unit section 41*a* and an auxiliary-unit section 41*b*.

It suffices that auxiliary heat exchange unit 40 is divided into one or more auxiliary-unit sections 41 in direction y in the figure. Auxiliary-unit sections 41 are disposed such that refrigerant continuously flows through auxiliary-unit sections 41 via an auxiliary-unit refrigerant pipe component 70. Auxiliary-unit refrigerant pipe component 70 is a refrigerant pipe component obtained by connecting a header collecting tube that collects refrigerant and a header dispensing tube that dispenses refrigerant by a pipe. Auxiliary-unit refrigerant pipe component 70 is not limited thereto and may be a refrigerant pipe that connects the refrigerant flow paths of heat transfer tubes 20 to each other in series.

Auxiliary heat exchange unit 40 further has a third auxiliary heat exchange region 413 and a fourth auxiliary heat exchange region 414. Third auxiliary heat exchange region 413 and fourth auxiliary heat exchange region 414 constitute an auxiliary-unit section 41*b*. Third auxiliary heat exchange region 413 is disposed between first auxiliary heat exchange region 411 and first main heat exchange region 311. Fourth auxiliary heat exchange region 414 is disposed between second auxiliary heat exchange region 412 and second main heat exchange region 312.

Auxiliary heat exchange unit 40 is configured to cause refrigerant to flow successively through first auxiliary heat exchange region 411, second auxiliary heat exchange region 412, third auxiliary heat exchange region 413, and fourth auxiliary heat exchange region 414 when heat exchanger 10 functions as an evaporator.

When heat exchanger 10 functions as an evaporator, refrigerant flows successively through auxiliary-unit section 41*a* and auxiliary-unit section 41*b* in auxiliary heat exchange unit 40. That is to say, in auxiliary heat exchange unit 40 of heat exchanger 10, auxiliary-unit section 41*a* is disposed most upstream in the flow of refrigerant of the evaporator. Auxiliary-unit section 41*a* will be referred to as auxiliary-unit upstream section 41*a* as appropriate. In auxiliary heat exchange unit 40 of heat exchanger 10, auxiliary-unit section 41*b* is disposed most downstream in the flow of refrigerant of the evaporator. Auxiliary-unit section 41*b* will be referred to as auxiliary-unit downstream section 41*b* as appropriate.

As described above, when heat exchanger 10 functions as an evaporator, auxiliary heat exchange unit 40 is the gas-liquid two-phase region. That is to say, refrigerant is located in the gas-liquid two-phase region in auxiliary-unit upstream section 41*a* and auxiliary-unit downstream section 41*b*.

Figure 7:
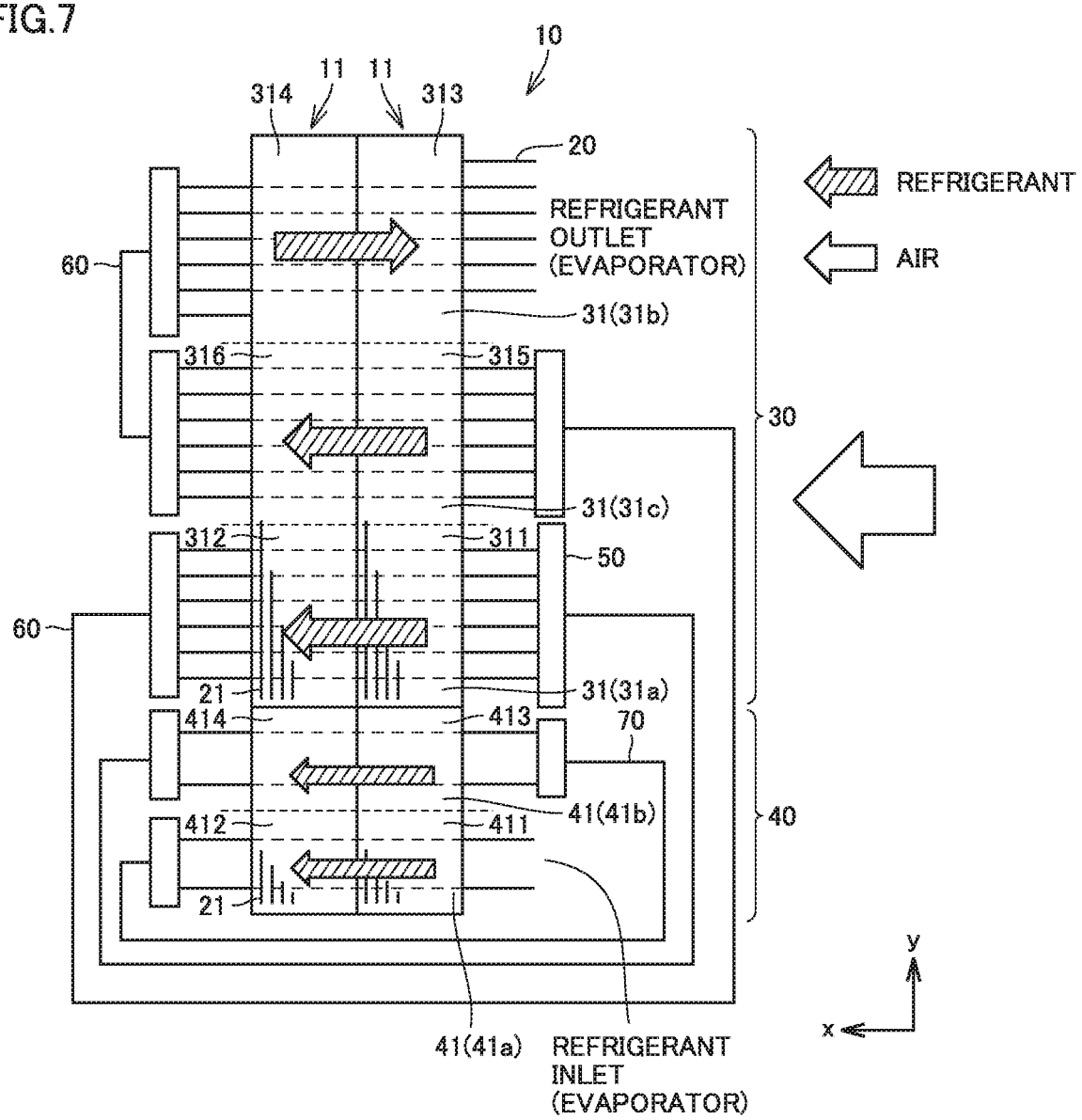
FIG. 7 is a schematic view showing an outline of a heat exchanger according to Modification 2 of Embodiment 1.

As shown in FIG. 7, when heat exchanger 10 functions as an evaporator, refrigerant flows into the windward bank portion and flows out of the leeward bank portion in auxiliary-unit upstream section 41*a* and auxiliary-unit downstream section 41*b*. Specifically, refrigerant flows from first auxiliary heat exchange region 411 toward second auxiliary heat exchange region 412. Refrigerant also flows from third auxiliary heat exchange region 413 toward fourth auxiliary heat exchange region 414. That is to say, when heat exchanger 10 functions as an evaporator, refrigerant and air flow parallel to each other in auxiliary-unit upstream section 41*a* and auxiliary-unit downstream section 41*b* that are the gas-liquid two-phase region. With the above configuration, the temperature of the heat exchanger is lower in the leeward bank portion than in the windward bank portion in auxiliary-unit upstream section 41*a* and auxiliary-unit downstream section 41*b*, and accordingly, a temperature difference between air and refrigerant can be secured in the leeward bank portion. The performance of the evaporator of heat exchanger 10 can thus be improved.

In heat exchanger 10 according to Modification 2 of the present embodiment, auxiliary heat exchange unit 40 further has third auxiliary heat exchange region 413 and fourth auxiliary heat exchange region 414, and thus causes refrigerant to flow in the gas-liquid two-phase state and air parallel to each other also in third auxiliary heat exchange region 413 and fourth auxiliary heat exchange region 414.

Next, heat exchanger 10 according to Modification 3 of the present embodiment will be described with reference to FIG. 8. FIG. 8 is a schematic view showing an outline of heat exchanger 10 when auxiliary heat exchange unit 40 is divided into three auxiliary-unit sections 41 in heat exchanger 10. As shown in FIG. 8, auxiliary heat exchange unit 40 is divided into auxiliary-unit section 41*a*, auxiliary-unit section 41*b*, and an auxiliary-unit section 41*c*.

Auxiliary heat exchange unit 40 further has a fifth auxiliary heat exchange region 415 and a sixth auxiliary heat exchange region 416. Fifth auxiliary heat exchange region 415 and sixth auxiliary heat exchange region 416 constitute auxiliary-unit section 41*c*. Fifth auxiliary heat exchange region 415 is disposed between third auxiliary heat exchange region 413 and first auxiliary heat exchange region 411. Sixth auxiliary heat exchange region 416 is disposed between fourth auxiliary heat exchange region 414 and second auxiliary heat exchange region 412.

Auxiliary heat exchange unit 40 is configured to cause refrigerant to flow successively through first auxiliary heat exchange region 411, second auxiliary heat exchange region 412, fifth auxiliary heat exchange region 415, sixth auxiliary heat exchange region 416, third auxiliary heat exchange region 413, and fourth auxiliary heat exchange region 414 when heat exchanger 10 functions as an evaporator.

When heat exchanger 10 functions as an evaporator, refrigerant flows successively through auxiliary-unit section 41*a*, auxiliary-unit section 41*c*, and auxiliary-unit section 41*b* in auxiliary heat exchange unit 40. That is to say, in auxiliary heat exchange unit 40 of heat exchanger 10, auxiliary-unit section 41*a* is disposed most upstream in the flow of refrigerant of the evaporator. Auxiliary-unit section 41*a* will be referred to as auxiliary-unit upstream section 41*a* as appropriate. In auxiliary heat exchange unit 40 of heat exchanger 10, auxiliary-unit section 41*b* is disposed most downstream in the flow of refrigerant of the evaporator. Auxiliary-unit section 41*b* will be referred to as auxiliary-unit downstream section 41*b* as appropriate. In auxiliary heat exchange unit 40 of heat exchanger 10, auxiliary-unit section 41*c* is disposed midstream between auxiliary-unit upstream section 41*a* and auxiliary-unit downstream section 41*b* in the flow of refrigerant of the evaporator. Auxiliary-unit section 41*c* will be referred to as auxiliary-unit midstream section 41*c* as appropriate.

Figure 8:
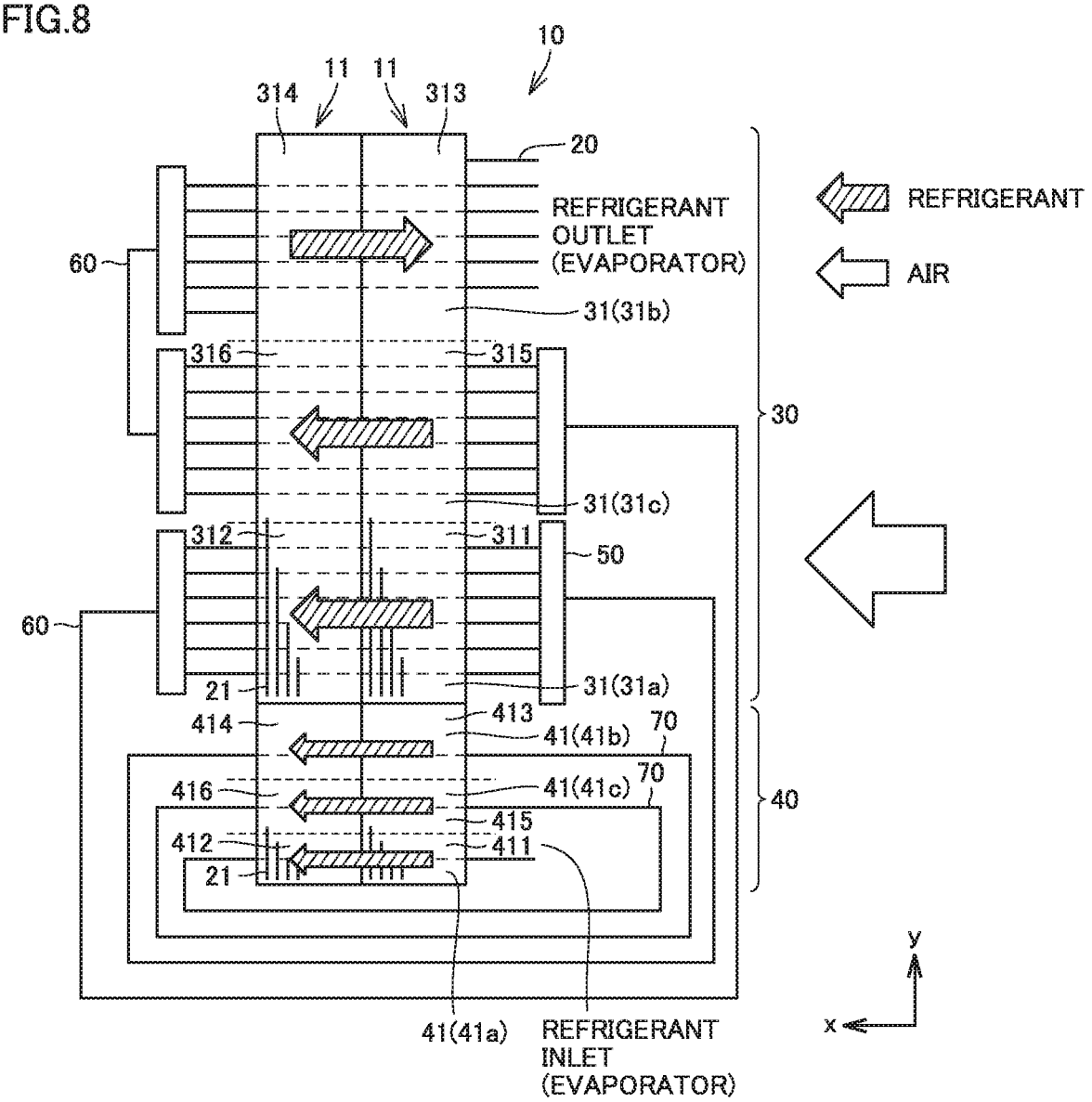
FIG. 8 shows an outline of a heat exchanger according to Modification 3 of Embodiment 1.

Although auxiliary-unit midstream section 41*c* is formed of one auxiliary-unit section 41 with reference to FIG. 8, the present invention is not limited thereto, and auxiliary-unit section 41*c* may be formed of two or more auxiliary-unit sections 41.

As described above, auxiliary heat exchange unit 40 is the gas-liquid two-phase region. That is to say, refrigerant is located in the gas-liquid two-phase region in auxiliary-unit upstream section 41*a*, auxiliary-unit midstream section 41*c*, and auxiliary-unit downstream section 41*b*.

As shown in FIG. 8, when heat exchanger 10 functions as an evaporator, refrigerant flows into the windward bank portion and flows out of the leeward bank portion in auxiliary-unit upstream section 41*a*, auxiliary-unit midstream section 41*c*, and auxiliary-unit downstream section 41*b*. Specifically, refrigerant flows from first auxiliary heat exchange region 411 toward second auxiliary heat exchange region 412. Refrigerant also flows from third auxiliary heat exchange region 413 toward fourth auxiliary heat exchange region 414. Refrigerant also flows from fifth auxiliary heat exchange region 415 toward sixth auxiliary heat exchange region 416. That is to say, when heat exchanger 10 functions as an evaporator, refrigerant and air flow parallel to each other in auxiliary-unit upstream section 41*a*, auxiliary-unit midstream section 41*c*, and auxiliary-unit downstream section 41*b* that are the gas-liquid two-phase region. With the above configuration, in auxiliary-unit upstream section 41*a*, auxiliary-unit midstream section 41*c*, and auxiliary-unit downstream section 41*b*, the temperature of the heat exchanger is lower in the leeward bank portion than in the windward bank portion, and accordingly, a temperature difference between air and refrigerant can be secured in the leeward bank portion. The performance of the evaporator of heat exchanger 10 can thus be improved.

The heat exchanger according to Modification 3 of the present embodiment, in which auxiliary heat exchange unit 40 further has fifth auxiliary heat exchange region 415 and sixth auxiliary heat exchange region 416, can cause refrigerant in the gas-liquid two-phase state and air to flow parallel to each other in fifth auxiliary heat exchange region 415 and sixth auxiliary heat exchange region 416. Also, auxiliary heat exchange unit 40 can be disposed in order of the upstream portion, midstream portion, and downstream portion in the flow of refrigerant to reduce a heat loss (thermal conduction loss) between refrigerants which is generated as the heat of refrigerant flowing through each of adjacent heat transfer tubes 20 moves along fins 21.

Embodiment 2

Heat exchanger 10 according to Embodiment 2 of the present invention will be described with reference to FIG. 9. Heat exchangers 10 in Embodiments 2 and 3 described below have the same components and effects as those of heat exchanger 10 according to Embodiment 1 of the present invention, unless otherwise noted. The same components as those of heat exchanger 10 according to the embodiment of the present invention will thus be denoted by the same references, description of which will not be repeated.

Figure 9:
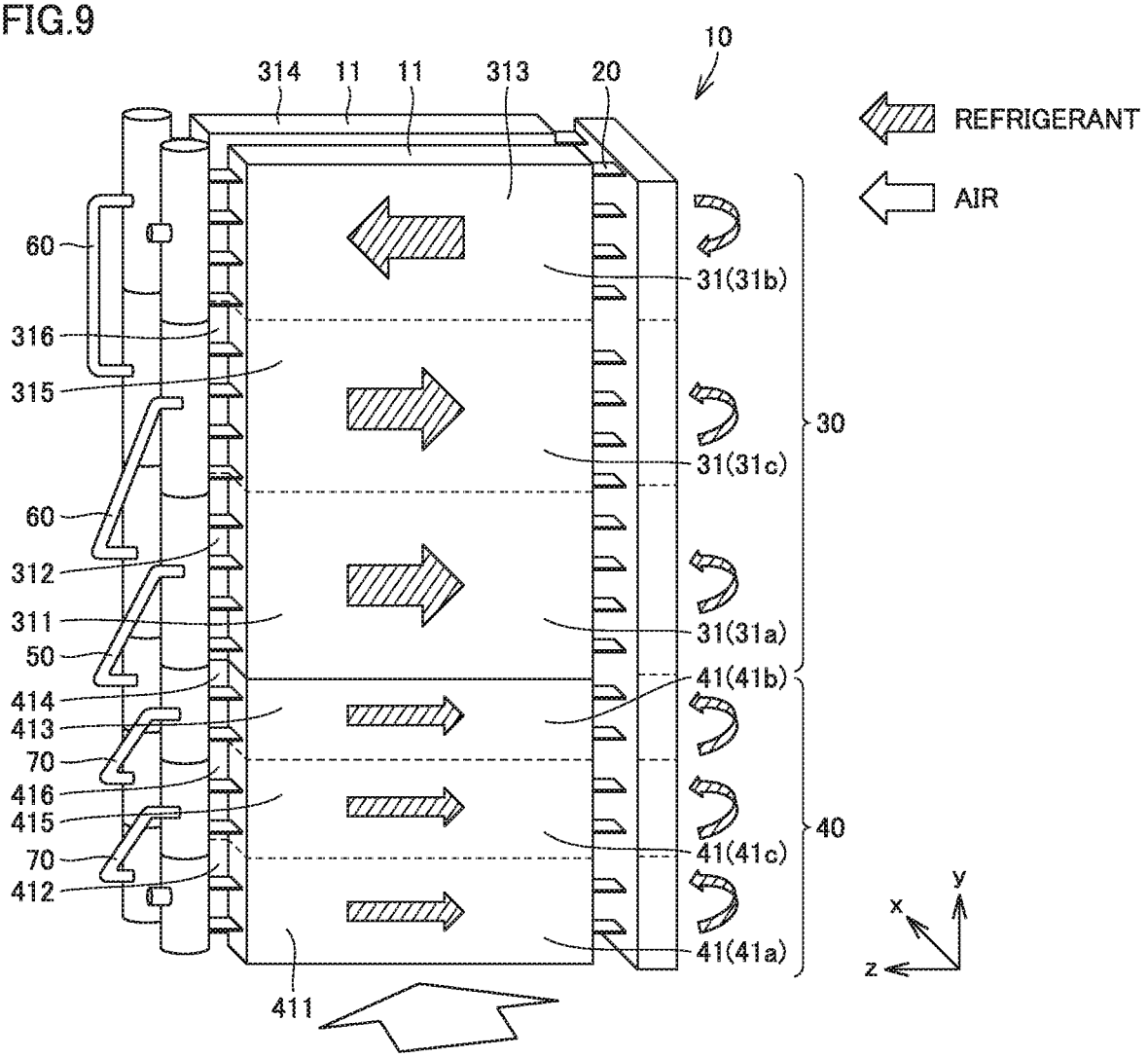
FIG. 9 is a perspective view showing an outline of a heat exchanger according to Embodiment 2.

FIG. 9 is a perspective view showing an outline of heat exchanger 10 according to Embodiment 2 of the present invention. As shown in FIG. 9, in heat exchanger 10, heat transfer tubes 20 extending horizontally (direction z in the figure) are disposed parallel to each other vertically (direction y in the figure), and main-unit downstream section 31*b*, main-unit midstream section 31*c*, main-unit upstream section 31*a*, auxiliary-unit downstream section 41*b*, auxiliary-unit midstream section 41*c*, and auxiliary-unit upstream section 41*a* are disposed in order from top to bottom.

Auxiliary-unit upstream section 41*a* has first auxiliary heat exchange region 411. Main-unit downstream section 31*b* has a third main heat exchange region 313. In main heat exchange unit 30 and auxiliary heat exchange unit 40, first auxiliary heat exchange region 411 serves as an inlet of refrigerant, and third main heat exchange region 313 serves as the outlet of refrigerant. Heat transfer tubes 20 are disposed to extend horizontally. Thus, main heat exchange unit 30 and auxiliary heat exchange unit 40 can be longitudinally positioned (vertically positioned).

As shown in FIG. 9, heat transfer tubes 20 of heat exchanger 10 are flat multi-hole tubes each of which has a flat-shaped outer shell and has a plurality of refrigerant flow paths formed therein. Alternatively, heat transfer tubes 20 are not limited thereto, and may be a circular tube having a refrigerant flow path with grooves formed therein.

Next, the function and effect of heat exchanger 10 according to the present embodiment will be described.

In heat exchanger 10 according to the present embodiment, in main heat exchange unit 30 and auxiliary heat exchange unit 40, first auxiliary heat exchange region 411 serves as the inlet of refrigerant, and third main heat exchange region 313 serves as the outlet of refrigerant. When the inlet and outlet of refrigerant are adjacent to each other, heat exchange occurs between refrigerants due to a refrigerant temperature difference, so that the heat of the refrigerant may not be conducted to air satisfactorily. In heat exchanger 10 according to the present embodiment, first auxiliary heat exchange region 411 of auxiliary-unit upstream section 41*a*, which serves as the inlet of refrigerant, and third main heat exchange region 313 of main-unit downstream section 31*b*, which serves as the outlet of refrigerant, are disposed apart from each other. This can prevent heat exchange occurring between refrigerants, so that the heat of refrigerant can be conducted to air satisfactorily. The performance of the heat exchange of heat exchanger 10 can thus be improved.

In heat exchanger 10 according to the present embodiment, heat transfer tubes 20 are disposed to extend horizontally, so that main heat exchange unit 30 and auxiliary heat exchange unit 40 can be vertically positioned.

Embodiment 3

Figure 10:
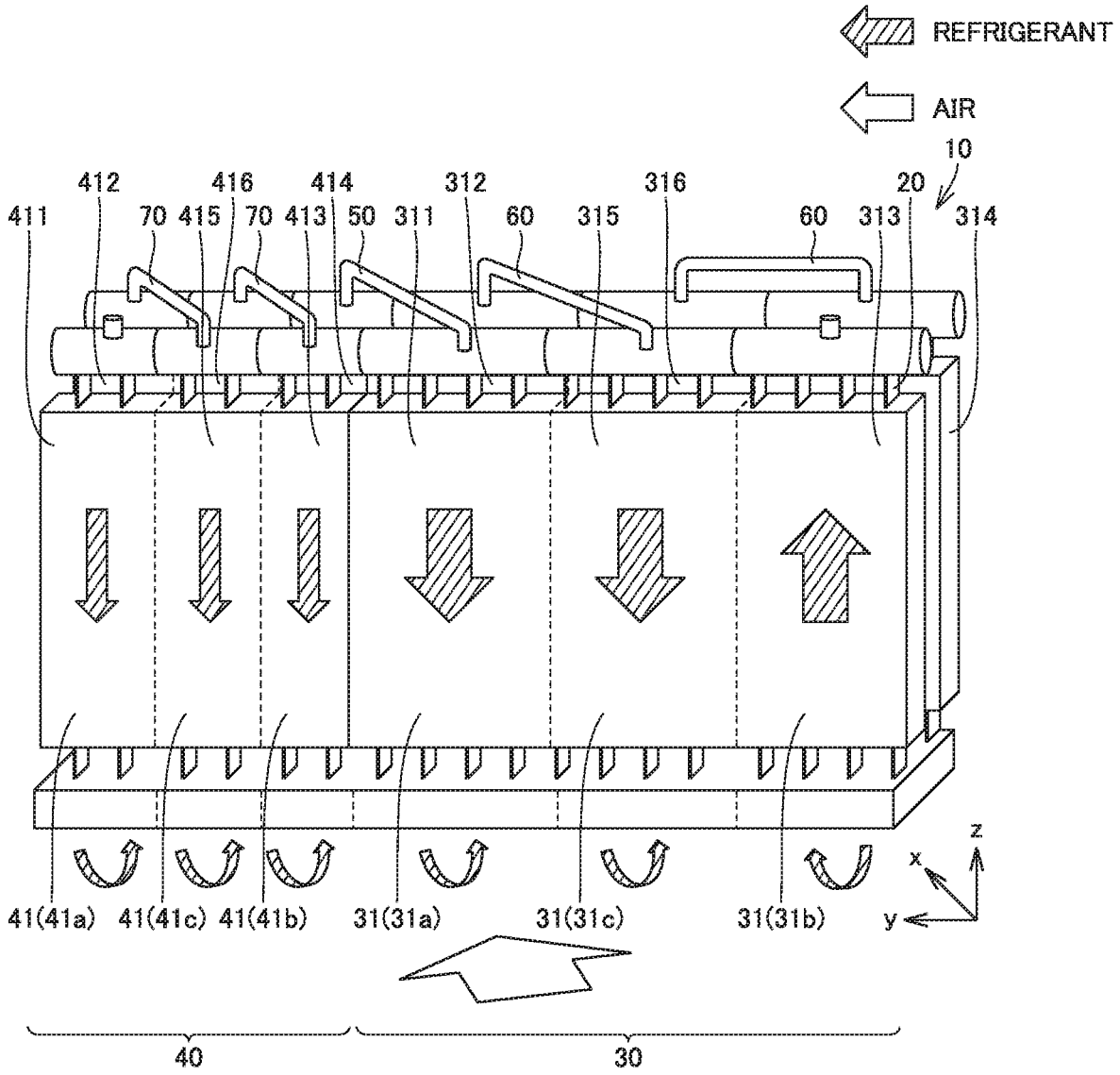
FIG. 10 is a perspective view showing an outline of a heat exchanger according to Embodiment 3.
Figure 11:
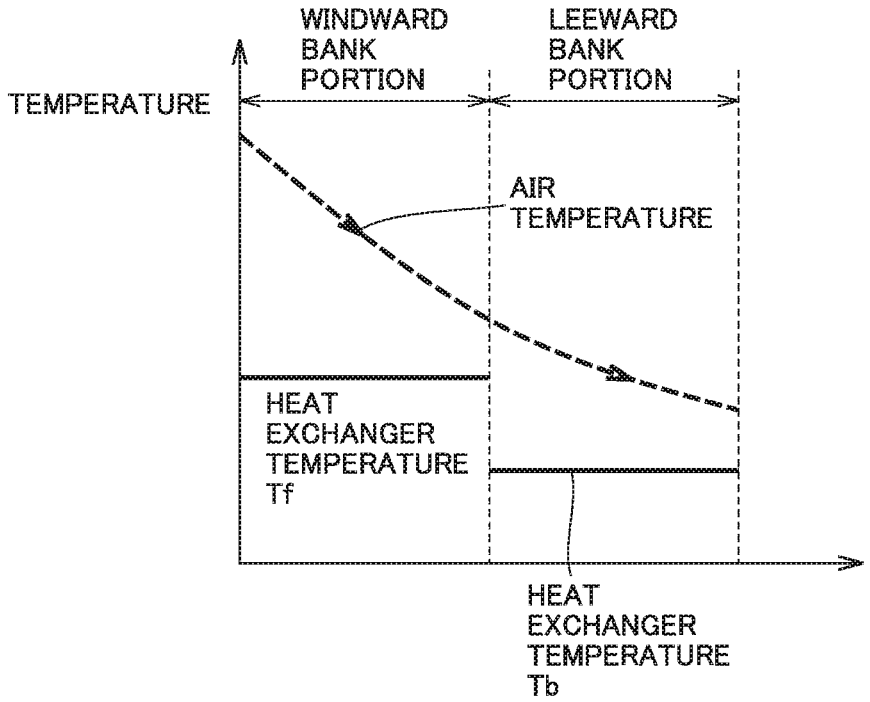
FIG. 11 is a temperature distribution chart schematically showing changes in temperatures of air and a heat exchange unit including a plurality of banks when the heat exchanger functions as an evaporator and when the heat exchanger temperature of the windward bank portion is higher than the heat exchanger temperature of the leeward bank portion.
Figure 12:
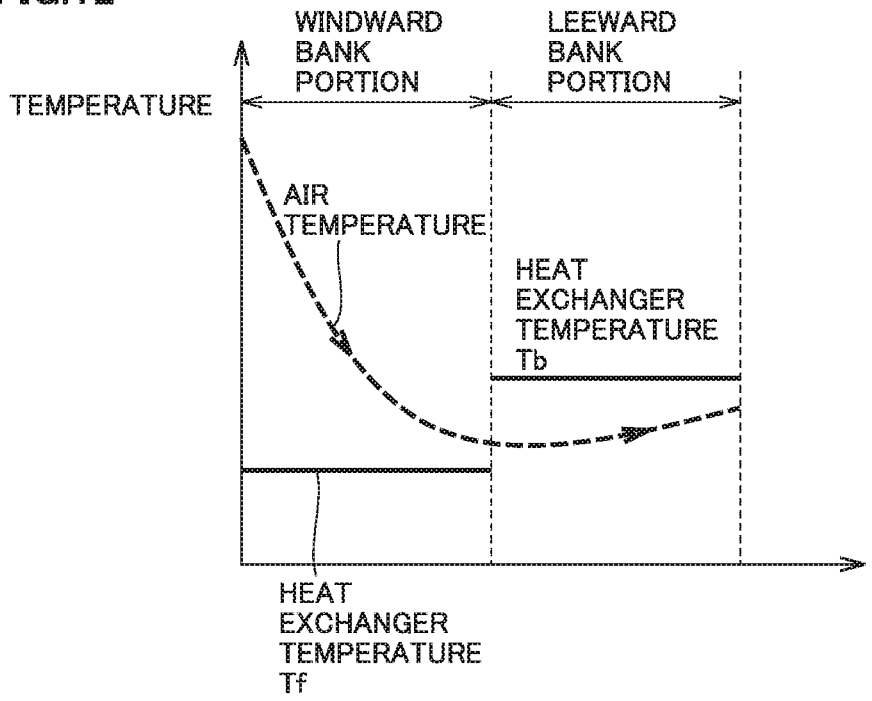
FIG. 12 is a temperature distribution chart schematically showing changes in temperatures of air and a heat exchange unit including a plurality of banks when the heat exchanger functions as an evaporator and when the heat exchanger temperature of the windward bank portion is lower than the heat exchanger temperature of the leeward bank portion.

Heat exchanger 10 according to Embodiment 3 of the present invention will be described with reference to FIG. 10. FIG. 10 is a perspective view showing an outline of heat exchanger 10 according to Embodiment 3 of the present invention. As shown in FIG. 10, in heat exchanger 10, heat transfer tubes 20 extending vertically (direction z in the figure) are disposed parallel to each other in the horizontal direction (direction y in the figure), and main-unit downstream section 31*b*, main-unit midstream section 31*c*, main-unit upstream section 31*a*, auxiliary-unit downstream section 41*b*, auxiliary-unit midstream section 41*c*, and auxiliary-unit upstream section 41*a* are disposed in order from one side to the other side in direction y in the figure. Heat transfer tubes 20 are disposed to extend vertically. Thus, main heat exchange unit 30 and auxiliary heat exchange unit 40 can be transversely positioned (horizontally positioned).

As shown in FIG. 10, each of heat transfer tubes 20 of heat exchanger 10 has a flat-shaped outer shell and have a plurality of refrigerant flow paths formed therein. Heat transfer tubes 20 are not limited thereto and may be a circular tube having a refrigerant flow path in which a groove is formed.

Next, the function and effect of heat exchanger 10 according to the present embodiment will be described.

Similarly to heat exchanger 10 according to Embodiment 2, also in heat exchanger 10 according to the present embodiment, first auxiliary heat exchange region 411 of auxiliary-unit upstream section 41*a* which serves as an inlet of refrigerant and third main heat exchange region 313 of main-unit downstream section 31*b* which serves as an outlet of refrigerant are disposed apart from each other. Consequently, heat exchange occurring between refrigerants can be prevented, satisfactorily conducting the heat of the refrigerant to the air. The heat exchange performance of heat exchanger 10 can thus be improved.

In heat exchanger 10 according to the present embodiment, heat transfer tubes 20 are disposed to extend vertically. Main heat exchange unit 30 and auxiliary heat exchange unit 40 can thus be transversely positioned.

It should be understood that the embodiments disclosed herein are illustrative and non-restrictive in every respect. The scope of the present invention is defined by the terms of the claims, rather than the description above, and is intended to include any modifications within the meaning and scope equivalent to the terms of the claims.

The invention claimed is:

1. A heat exchanger having a plurality of heat transfer tubes for heat exchange between refrigerant flowing inside the plurality of heat transfer tubes and air flowing outside the plurality of heat transfer tubes, the heat exchanger comprising:

an auxiliary heat unit exchanger having a first auxiliary heat exchange region, and a second auxiliary heat exchange region facing the first auxiliary heat exchange region in a flow direction in which the air flows; and a main heat exchanger having a first main heat exchange region, a second main heat exchange region facing the first main heat exchange region in the flow direction, a third main heat exchange region disposed opposite to the first auxiliary heat exchange region across the first main heat exchange region, and a fourth main heat exchange region facing the third main heat exchange region in the flow direction and disposed opposite to the second auxiliary heat exchange region across the second main heat exchange region, wherein the plurality of heat transfer tubes of each of the first auxiliary heat exchange region and the second auxiliary heat exchange region are fewer than the plurality of heat transfer tubes of each of the first main heat exchange region, the second main heat exchange region, the third main heat exchange region, and the fourth main heat exchange region, the first auxiliary heat exchange region, the first main heat exchange region, and the third main heat exchange region are disposed windward of the second auxiliary heat exchange region, the second main heat exchange region, and the fourth main heat exchange region, respectively, in the flow direction, the auxiliary heat exchanger and the main heat exchanger are configured to cause the refrigerant to flow successively through the first auxiliary heat exchange region, the second auxiliary heat exchange region, the first main heat exchange region, the second main heat exchange region, the fourth main heat exchange region, and the third main heat exchange region when the heat exchanger functions as an evaporator, the main heat exchanger has a fifth main heat exchange region disposed between the first main heat exchange region and the third main heat exchange region, and a sixth main heat exchange region disposed between the second main heat exchange region and the fourth main heat exchange region, and the main heat exchanger is configured to cause the refrigerant to flow successively through the first main heat exchange region, the second main heat exchange region, the fifth main heat exchange region, the sixth main heat exchange region, the fourth main heat exchange region, and the third main heat exchange region when the heat exchanger functions as the evaporator.

2. The heat exchanger according to claim 1, wherein the plurality of heat transfer tubes are disposed to extend horizontally.

3. The heat exchanger according to claim 1, wherein the plurality of heat transfer tubes are disposed to extend vertically.

4. The heat exchanger according to claim 1, wherein in the main heat exchanger and the auxiliary heat exchanger, the first auxiliary heat exchange region serves as an inlet of the refrigerant connected by a refrigerant pipe, and the third main heat exchange region serves as an outlet of the refrigerant connected by the refrigerant pipe.

5. A heat exchanger having a plurality of heat transfer tubes for heat exchange between refrigerant flowing inside the plurality of heat transfer tubes and air flowing outside the plurality of heat transfer tubes, the heat exchanger comprising:

an auxiliary heat exchanger having a first auxiliary heat exchange region, and a second auxiliary heat exchange region facing the first auxiliary heat exchange region in a flow direction in which the air flows; and a main heat exchanger having a first main heat exchange region, a second main heat exchange region facing the first main heat exchange region in the flow direction, a third main heat exchange region disposed opposite to the first auxiliary heat exchange region across the first main heat exchange region, and a fourth main heat exchange region facing the third main heat exchange region in the flow direction and disposed opposite to the second auxiliary heat exchange region across the second main heat exchange region, wherein the plurality of heat transfer tubes of each of the first auxiliary heat exchange region and the second auxiliary heat exchange region are fewer than the plurality of heat transfer tubes of each of the first main heat exchange region, the second main heat exchange region, the third main heat exchange region, and the fourth main heat exchange region, the first auxiliary heat exchange region, the first main heat exchange region, and the third main heat exchange region are disposed windward of the second auxiliary heat exchange region, the second main heat exchange region, and the fourth main heat exchange region, respectively, in the flow direction, the auxiliary heat exchanger and the main heat exchanger are configured to cause the refrigerant to flow successively through the first auxiliary heat exchange region, the second auxiliary heat exchange region, the first main heat exchange region, the second main heat exchange region, the fourth main heat exchange region, and the third main heat exchange region when the heat exchanger functions as an evaporator, the auxiliary heat exchanger has a third auxiliary heat exchange region disposed between the first auxiliary heat exchange region and the first main heat exchange region, and a fourth auxiliary heat exchange region disposed between the second auxiliary heat exchange region and the second main heat exchange region, and the auxiliary heat exchanger is configured to cause the refrigerant to flow successively through the first auxiliary heat exchange region, the second auxiliary heat exchange region, the third auxiliary heat exchange region, and the fourth auxiliary heat exchange region when the heat exchanger functions as the evaporator.

6. The heat exchanger according to claim 5, wherein the auxiliary heat exchanger has a fifth auxiliary heat exchange region disposed between the third auxiliary heat exchange region and the first auxiliary heat exchange region, and a sixth auxiliary heat exchange region disposed between the fourth auxiliary heat exchange region and the second auxiliary heat exchange region, and the auxiliary heat exchanger is configured to cause the refrigerant to flow successively through the first auxiliary heat exchange region, the second auxiliary heat exchange region, the fifth auxiliary heat exchange region, the sixth auxiliary heat exchange region, the third auxiliary heat exchange region, and the fourth auxiliary heat exchange region when the heat exchanger functions as the evaporator.

7. A refrigeration cycle apparatus comprising:

a heat exchanger having a plurality of heat transfer tubes for heat exchange between refrigerant flowing inside the plurality of heat transfer tubes and air flowing outside the plurality of heat transfer tubes, the heat exchanger comprising:

an auxiliary heat exchanger having a first auxiliary heat exchange region, and a second auxiliary heat exchange region facing the first auxiliary heat exchange region in a flow direction in which the air flows; and a main heat exchanger having a first main heat exchange region, a second main heat exchange region facing the first main heat exchange region in the flow direction, a third main heat exchange region disposed opposite to the first auxiliary heat exchange region across the first main heat exchange region, and a fourth main heat exchange region facing the third main heat exchange region in the flow direction and disposed opposite to the second auxiliary heat exchange region across the second main heat exchange region, wherein the plurality of heat transfer tubes of each of the first auxiliary heat exchange region and the second auxiliary heat exchange region are fewer than the plurality of heat transfer tubes of each of the first main heat exchange region, the second main heat exchange region, the third main heat exchange region, and the fourth main heat exchange region, the first auxiliary heat exchange region, the first main heat exchange region, and the third main heat exchange region are disposed windward of the second auxiliary heat exchange region, the second main heat exchange region, and the fourth main heat exchange region, respectively, in the flow direction, the auxiliary heat exchanger and the main heat exchanger are configured to cause the refrigerant to flow successively through the first auxiliary heat exchange region, the second auxiliary heat exchange region, the first main heat exchange region, the second main heat exchange region, the fourth main heat exchange region, and the third main heat exchange region when the heat exchanger functions as an evaporator, the main heat exchanger has a fifth main heat exchange region disposed between the first main heat exchange region and the third main heat exchange region, and a sixth main heat exchange region disposed between the second main heat exchange region and the fourth main heat exchange region, and the main heat exchanger is configured to cause the refrigerant to flow successively through the first main heat exchange region, the second main heat exchange region, the fifth main heat exchange region, the sixth main heat exchange region, the fourth main heat exchange region, and the third main heat exchange region when the heat exchanger functions as the evaporator;

a compressor for compressing the refrigerant that flows into the heat exchanger; and a blower for causing the air to flow to the heat exchanger.

* * * * *